United States Patent [19]

Scherrer

[11] 4,077,684

[45] Mar. 7, 1978

[54] STOP DEVICE FOR SLIDING COMPARTMENTS DISPOSED SIDE BY SIDE

[75] Inventor: Kurt Scherrer, Munsingen, Switzerland

[73] Assignee: U. Scharer Sohne AG, (USM), Munsingen, Switzerland

[21] Appl. No.: 725,544

[22] Filed: Sep. 22, 1976

[30] Foreign Application Priority Data

Oct. 1, 1975 Switzerland ..... 122744/75

[51] Int. Cl.[2] ..... E05C 7/06

[52] U.S. Cl. ..... 312/220; 74/25; 312/348

[58] Field of Search ..... 312/107.5, 346, 220, 312/221, 348; 74/99, 25, 100, 110

[56] References Cited

U.S. PATENT DOCUMENTS

| | | | |
|---|---|---|---|
| 1,031,751 | 7/1912 | Weiss | 312/107.5 |
| 2,125,139 | 7/1938 | Wasley | 312/346 |
| 2,911,835 | 11/1959 | Smith | 74/25 |
| 3,062,062 | 11/1962 | Loomis | 74/99 |
| 3,874,755 | 4/1975 | Hegg et al. | 312/107.5 |

FOREIGN PATENT DOCUMENTS

| | | | |
|---|---|---|---|
| 460,050 | 11/1913 | France | 312/221 |

*Primary Examiner*—Samuel Scott
*Assistant Examiner*—Wesley S. Ratliff, Jr.
*Attorney, Agent, or Firm*—Zarley, McKee, Thomte, Voorhees & Sease

[57] ABSTRACT

A mechanism comprising two interlockable pivoting members is installed between two adjacent sliding compartments in such a way that withdrawal of one compartment causes the associated member to pivot and interlock with the other member, thereby securing the latter in a position in which a catch blocks the other compartment and prevents it from being withdrawn simultaneously.

2 Claims, 4 Drawing Figures

STOP DEVICE FOR SLIDING COMPARTMENTS DISPOSED SIDE BY SIDE

This invention relates to a stop device for sliding compartments disposed side by side in a supporting structure.

Whenever more than one compartment is slid out of a supporting structure containing sliding compartments, such as a chest of drawers, a filing cabinet, or the like, there is a danger of the structure's tipping over forward owing to the shift of its center of gravity. Thus it is desirable to provide means for ensuring that only one compartment can be pulled out at a time.

In prior art structures having compartments disposed one above the other, this has been accomplished by means of a system of locking levers extending along substantially the entire back of the structure.

It is an object of this invention to provide such locking means suitable for structures in which the sliding compartments are disposed side by side.

A further object of this invention is to provide locking means of the aforementioned kind which can easily be built into already existing structures.

To this end, the stop device according to the present invention comprises a base plate for mounting between two adjacent sliding compartments, two interlockable pivoting members disposed on the base plate and respectively associated with the two compartments, two control beaks respectively projecting from the pivoting members into the sliding paths of the associated compartments, two catches respectively projecting from the pivoting members toward the associated compartments and situated in or out of the sliding paths of these compartments depending upon the pivoting positions of the pivoting members, and locking means disposed between the pivoting members and actuatable by the control beaks.

Figure 1:
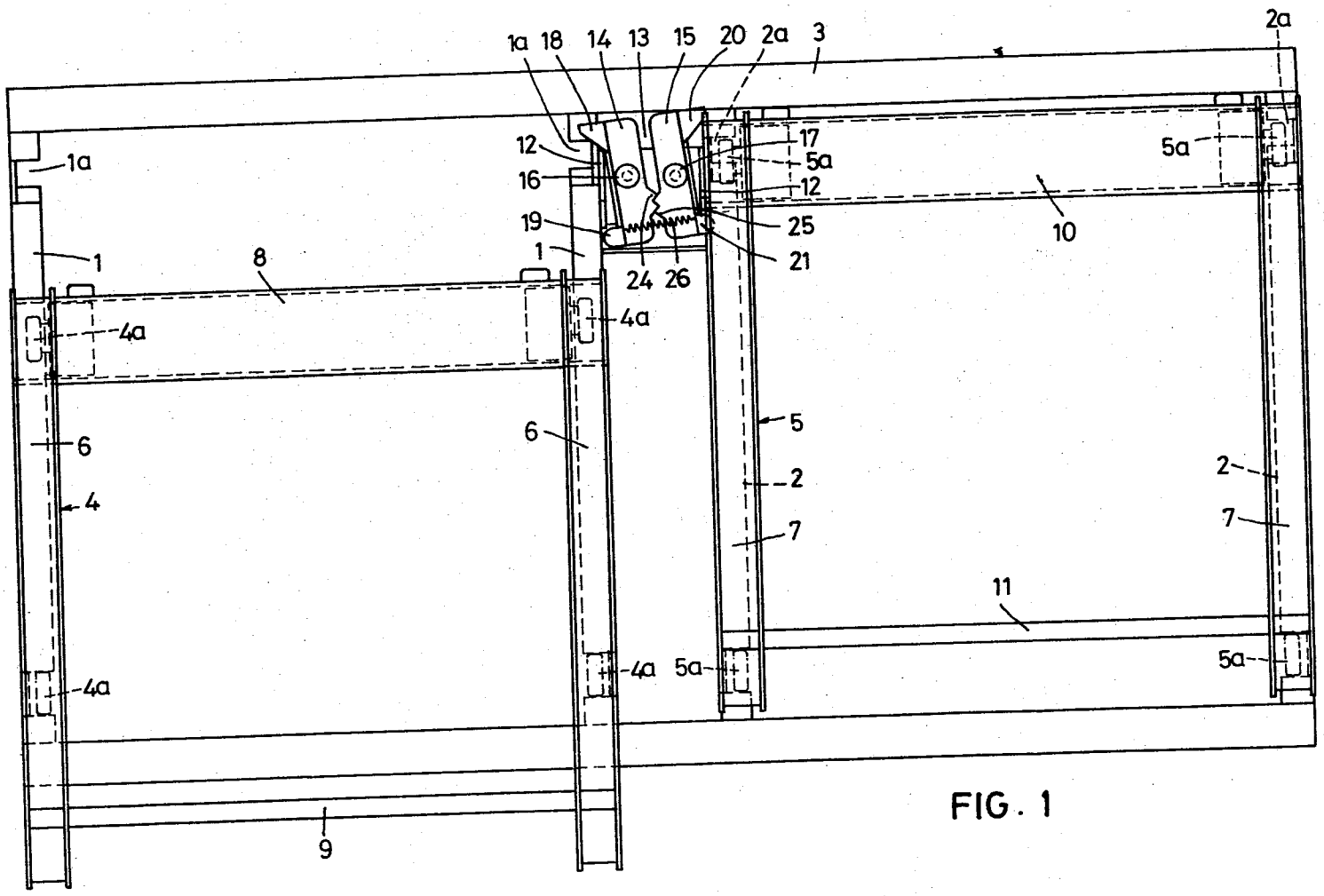
Figure 2:
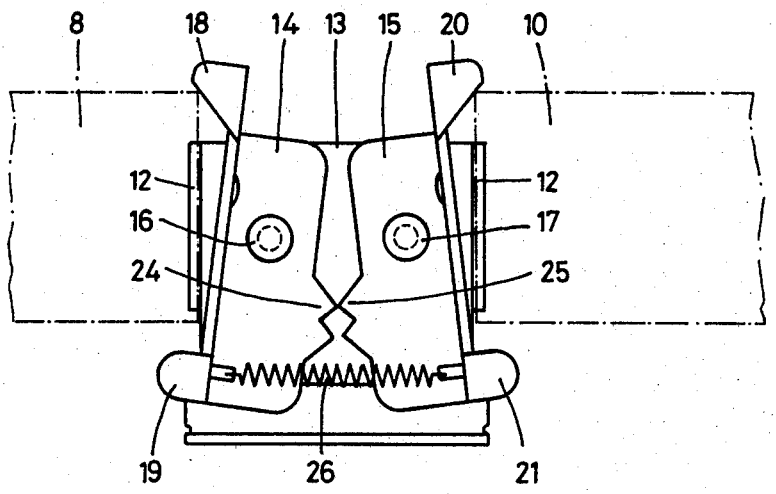
Figure 3:
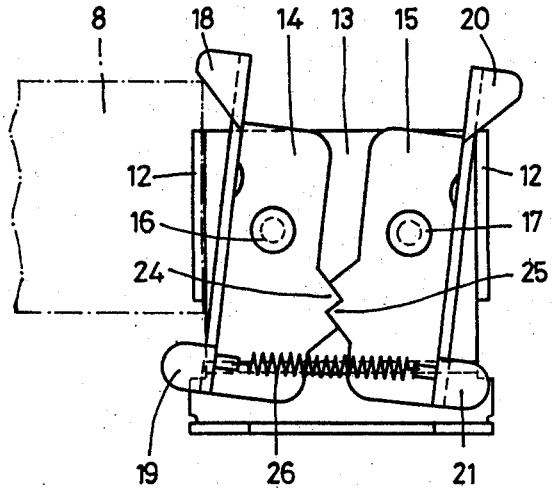
Figure 4:
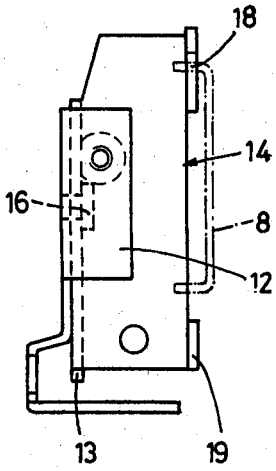

A preferred embodiment of the invention will now be described in detail with reference to the accompanying drawings, in which:

FIG. 1 is a top plan view of a structure having two sliding compartments disposed side by side with a stop device situated between them, FIG. 2 is a top plan view on a larger scale of the stop device in its resting position, FIG. 3 is an analogous view of the stop device in one of its operative positions, and FIG. 4 is a side elevation of the stop device of FIG. 3.

In the embodiment illustrated, the stop device alternatively secures one or the other of two compartments 4 and 5 which are slidable back and forth on tracks 1 and 2 of a structure 3. Tracks 1 and 2 are U-shaped sections, with the legs of the sections respectively associated with compartments 4 and 5 facing each other. Each of the lower legs serves as a runway for two rollers *4a, 5a* disposed on the underside of the respective compartment 4, 5 and has at its rearmost end a cutout portion *1a, 2a* into which the rear roller *4a, 5a* drops when the respective compartment is pushed back all the way into structure 3 (cf. the right-hand portion of FIG. 1), so that cutouts *1a* and *2a* determine the pushed-in positions of compartments 4 and 5, respectively, and these compartments can be pulled forward out of their pushed-in positions only by overcoming a certain amount of resistance. Side pieces 6 and 7 of compartments 4 and 5 may be designed, in a manner known per se, as rails on which a file container (not shown) moves by means of rollers. Side pieces 6 and 7 are respectively connected to one another by crosspieces 8 and 9, connecting side pieces 6, and crosspieces 10 and 11, connecting side pieces 7. Rear crosspieces 8 and 10 are comparatively broad and of a U-shaped cross-section. A base plate 13 is secured by means of its upwardly bent side edges 12 between neighboring tracks 1 and 2. On base plate 13, members 14 and 15 are mounted for pivoting within certain limits about bolts 16 and 17, respectively. At the ends of one edge of each pivoting member 14, 15 are outwardly extending lateral projections 18, 19 and 20, 21 respectively. The distance between the two projections of each pivoting member is somewhat greater than the width of rear crosspieces 8 and 10. The dimensions are also such that projections 18 and 20 extend at all times into the paths of rear crosspieces 8 and 10 of adjacent compartments 4 and 5, respectively, while projections 19 and 21 extend into those paths only when they are pivoted outwardly. Projections 19 and 21 take the form of catches, whereas projections 18 and 20 take the form of control beaks. The facing sides of pivoting members 14 and 15 each have teeth 24 and 25, respectively; these teeth serve as locking means and can be held in meshing engagement in the operative positions of pivoting members 14 and 15 by means of a spring 26 connecting the latter.

FIG. 2 shows the resting position in which both compartments 4 and 5 are in their rearmost, pushed-in positions determined by rollers *4a* and *5a* having dropped into cutouts *1a* and *2a*, respectively. The relative layout between the position-determining cutouts *1a, 2a*, on the one hand, and base plate 13 together with control beaks 18 and 20, on the other hand, is such that in this position, crosspieces 8 and 10 press against control beaks 18 and 20, so that pivoting member 14 is held in a clockwise-pivoted position, and pivoting member 15 in a counterclockwise-pivoted position, overcoming the bias exerted by spring 26. The uppermost of teeth 24 and 25, as viewed in the drawing, are then positioned immediately opposite one another with minimum spacing.

If, starting from this resting position, one of the compartments, e.g., compartment 4 (at the left of FIG. 1) is pulled out, crosspiece 8 thereof strikes against catch 19 of pivoting member 14, whereby the latter is rotated counterclockwise by the small amount determined by the spacing between the opposed uppermost of teeth 24 and 25. Upon further rotation, the uppermost of teeth 24 rests against the corresponding one of teeth 25, so that the movement of rotation is transmitted to pivoting member 15, whereby the immediately adjacent position of the two teeth disappears, and pivoting member 14 is pivoted by the biasing action of spring 26 into the release position according to FIG. 1 and secured in this position in that its teeth 24 mesh with teeth 25 of pivoting member 15. The latter is thereby locked in its resting position, in which catch 21 extends into the path of crosspiece 10 of compartment 5 (at the right of FIG. 1) and thus rests against the leading edge thereof. Consequently, in this operative position of catch 21, the associated compartment 5 is blocked and cannot be slid forward. If compartment 4 is then pushed in, its crosspiece 8 strikes against control beak 18 of pivoting member 14, so that teeth 24 are disengaged from teeth 25 of pivoting member 15, overcoming the bias exerted by spring 26, whereby pivoting members 14 and 15 regain their resting positions according to FIG. 2, and either one of compartments 14 and 15 can be pulled out. If compartment 5 is then pulled out, pivoting member 15 assumes the locking position shown in FIG. 3, so that compartment 4 is secured by means of catch 19.

Hence one of the two compartments 4 and 5 is always automatically blocked as soon as the other is pulled out. When both compartments are pushed in all the way, pivoting members 14 and 15 are in the resting position shown in FIG. 2, in which catches 19 and 21, although they extend into the paths of the respective crosspieces 8 and 10, are not blocked in that position, so that either of the compartments may be pulled out at will, as a result of which the other compartment stays blocked in its pushed-in position through the locking of the respective catch when it moves into its operative position.

The stop device described above is of very simple contruction and can, moreover, be easily installed between the adjacent tracks of existing structures.

What is claimed is:

1. A stop device for sliding compartments disposed side by side in a supporting structure, comprising:

a base plate for mounting between two adjacent said compartments, two interlockable pivoting members disposed on said base plate and respectively associated with said two compartments, two control beaks respectively projecting from said pivoting members into the sliding paths of said associated comparts, two catches respectively projecting from said pivoting members toward said associated compartments and being situated in or out of the sliding paths of said compartments depending upon the pivoting positions of said pivoting members, and locking means disposed between said pivoting members and actuable by said control beaks.

2. The stop device of claim 1, wherein said locking means comprises teeth disposed on facing sides of said pivoting members and a spring connecting said pivoting members for holding said teeth in meshing engagement.

* * * * *